US008640357B2

(12) United States Patent
Engin

(10) Patent No.: US 8,640,357 B2
(45) Date of Patent: Feb. 4, 2014

(54) LABORATORY TYPE QUICK FILM DRYING OVEN

(76) Inventor: Hasan Huseyin Engin, Istanbul (TR)

( * ) Notice: Subject to any disclaimer, the term of this patent is extended or adjusted under 35 U.S.C. 154(b) by 350 days.

(21) Appl. No.: 13/258,328

(22) PCT Filed: Mar. 23, 2010

(86) PCT No.: PCT/EP2010/053796

§ 371 (c)(1),
(2), (4) Date: Sep. 21, 2011

(87) PCT Pub. No.: WO2010/108930

PCT Pub. Date: Sep. 30, 2010

(65) Prior Publication Data

US 2012/0011737 A1 Jan. 19, 2012

(30) Foreign Application Priority Data

Mar. 23, 2009 (TR) ..... 2009/02202

(51) Int. Cl.
*F26B 5/06* (2006.01)

(52) U.S. Cl.
USPC ..... 34/259; 34/266; 34/275; 34/60; 34/202; 219/694; 126/21 A; 422/63

(58) Field of Classification Search
USPC ..... 34/259, 266, 275, 58, 60, 201, 202, 34/210, 218, 242; 219/691, 694, 740; 126/21 A, 190; 422/99, 62, 63
See application file for complete search history.

(56) References Cited

U.S. PATENT DOCUMENTS 2,716,694 A * 8/1955 Schroeder ..... 219/741
3,676,058 A * 7/1972 Gray ..... 422/21
4,210,795 A * 7/1980 Lentz ..... 219/709
4,308,445 A * 12/1981 Offutt ..... 219/755
4,625,089 A * 11/1986 Gics ..... 219/694
4,835,354 A 5/1989 Collins
5,320,804 A * 6/1994 Zakaria et al. ..... 422/21
5,423,260 A 6/1995 Goldberg
5,477,623 A * 12/1995 Tomizawa et al. ..... 34/58
5,946,816 A * 9/1999 Smith ..... 34/265
6,247,246 B1 * 6/2001 Scalese et al. ..... 34/259
6,470,597 B1 * 10/2002 Stipp ..... 34/422
RE38,412 E * 2/2004 Munter et al. ..... 34/248
6,793,890 B2 * 9/2004 Morales et al. ..... 422/536
8,221,996 B2 * 7/2012 Morales et al. ..... 435/40.5
8,288,168 B2 * 10/2012 Morales ..... 436/174

(Continued)

FOREIGN PATENT DOCUMENTS

DE 20200186 5/2002
GB 2074826 11/1981
JP 04035905 A * 2/1992 ..... B28B 3/20
JP 11083326 A * 3/1999 ..... F26B 23/04

(Continued)

*Primary Examiner* — Steve M Gravini

(74) *Attorney, Agent, or Firm* — Epstein Drangel, LLP; Robert L. Epstein

(57) ABSTRACT

The drying oven of the present invention comprises a holey plastic plate that can make planetary rotation. The drying mechanisms may consist of classical resistance heaters, blowing heaters and/or coolers, and ultraviolet, infrared and microwave radiation sources in horizontal, vertical or intermediate angle arrangements. There is an absorbent material in a reservoir so as to absorb the excess energy transmitted by the system. The present system completes the drying procedure quickly with full automatization within a standard period without deteriorating the sample and reveals a product which is ready to further processing.

12 Claims, 2 Drawing Sheets

(56) References Cited

U.S. PATENT DOCUMENTS

| | | | | |
|---|---|---|---|---|
| 8,561,314 | B2 * | 10/2013 | Kruger | 34/92 |
| 2002/0122743 | A1 * | 9/2002 | Huang | 422/24 |
| 2010/0132210 | A1 * | 6/2010 | Kruger | 34/259 |

FOREIGN PATENT DOCUMENTS

| | | | | | |
|---|---|---|---|---|---|
| JP | 2000220963 | A * | 8/2000 | F26B 5/04 |
| WO | WO 2007051653 | A1 * | 5/2007 | H05B 6/64 |
| WO | WO 2010108930 | A2 * | 9/2010 | |

* cited by examiner

LABORATORY TYPE QUICK FILM DRYING OVEN

FIELD OF THE INVENTION

The present invention relates to an oven for drying colored chemicals in the form of paint or grout like films quickly within a shortened and standard period where less energy is consumed and chemical structure is not spoiled, for instance before color measurement via spectrophotometer.

BACKGROUND OF THE INVENTION

Drying ovens are known in the technical field. Drying of the color samples before color measurement is a necessity in the paint industry. The reason is that accurate measurement of color cannot be carried out in a wet media and there is absolute necessity for establishing a convenient drying environment. This treatment, in water based systems, currently takes 10-30 minutes at 45-50° C. with conventional heaters depending on assortment of the sample and treatment thickness, where this causes the paint vessels in the production site to wait for laboratory measurement results of the sample coloring for long periods. The drying period in solvent based systems is much longer.

Conventional drying ovens are large scale and high power ovens with classical resistances. Drying with microwave or other rays is also utilized in many fields including food industry. The waves that arise from magnetron dipole in microwave applications according to the communication technique standards are always passed through a pre-wave guiding and directed to the object, and in the mean time various modes and harmonics of the signal are formed, the object exposed to a mixture of said mode and harmonics is dried but also heated.

In the present invention a wet film is placed right in front of the dipole, thus first wave is captured without formation of the mode and harmonics responsible for heating of the sample. Heating of the sample may lead to a color change and brightness loss. The present invention, before color measurement of the colored paint and grout is carried out via spectrophotometer, advantageously reduces the drying period from 10-30 minutes to the extent of a couple of minutes. This practice also provides considerable saving of time and energy in the solvent based systems when used together with infrared rays. Despite the fact that said sample dries very quickly, it is not heated, and as a consequence no considerable deviation in the color and brightness is observed. Hence, the samples received by the laboratory for color control become readable without deterioration in dry form within a shortened and standard period.

On the other hand the device of the present invention provides a standard drying procedure independent of human control where initiative of the laboratorian conducting such drying procedure becomes unnecessary due to the fact that the device dries the sample within a standard period without further investigating as to whether the sample is sufficiently dried.

Drying oven of the present invention also conducts the processes as regards quick drying without blanching the sample, drying with very low degree of energy and drying within a standard period. Apart from that, the device may find utilization in the fields such as disinfection/sterilization or food/chemistry. The drying oven according to the present invention carries out drying procedure more quickly and with less energy consumption as compared to the classical drying ovens without deteriorating the sample by way of any suitable combination of rays such as ultraviolet, infrared, microwave, and classical resistances or other thermal sources such as hot air/cold air.

OBJECTS OF THE INVENTION

One of the most important objects of the present invention is to provide a drying oven which is able to dry the paint samples sufficiently and quickly prior to color measurement thereof without color change and loss of brightness.

Another object of the present invention is to provide a drying procedure within a standard procedure independent of human control where initiative of the laboratorian conducting such drying procedure and investigation as to whether the sample is sufficiently dried become unnecessary.

A further object of the present invention is to provide such a drying procedure with minimum energy consumption.

SUMMARY OF THE INVENTION

A drying oven comprising a bidirectionally rotating planetary plate for drying a product sample is disclosed. The oven dries the sample quickly and automatically within a standard period. The sample carries a paint, a chemical substance or a food material for drying. The oven further comprises a first drying means emitting microwaves, a second drying means emitting ultraviolet or infrared waves wherein the planetary plate accommodating the sample is located at a position one fourth of the wavelength away from said first drying means. The drying oven may further comprise a further drying means in the form of a resistance heater or a blower.

In an embodiment of the invention, the drying oven disclosed hereby comprises a holey and slowly rotating plastic plate which is actuated by drying air impinging upon its side vanes, or by a low power motor-reducer group which can make bidirectional rotation. Drying mechanisms may consist of classical resistance heaters, blowing heaters and/or coolers, and microwave radiation sources emitting ultraviolet, infrared waves in horizontal and vertical direction or in intermediate angles. There is a charcoal like absorbent material in a reservoir so as to absorb the excess energy transmitted by the microwave source. The absorbent chamber may also be cooled. The present system completes the drying procedure with full automatization within envisaged period and the final product becomes ready to further processing.

The sample is exposed to the half of the first emitted wave as it is very close to the microwave source dipole. In other words samples stand in a distance of one fourth of the wave length from the dipole exterior surface. Hence, the molecules having dipole moment, e.g. water, are removed before the sample is substantially heated. Thus, the sample is substantially prevented from being exposed to harmonics and modes. Also more homogenous application is achieved by rotating the samples in their own axis.

BRIEF DESCRIPTION OF THE FIGURES

The following are the brief explanations pertaining to the drawings appended to the present description for understanding the invention more clearly. Said drawings are in no way limiting and are included for the sole purpose of clarifying the invention. Accordingly.

DETAILED DESCRIPTION OF THE INVENTION

Figure 1:
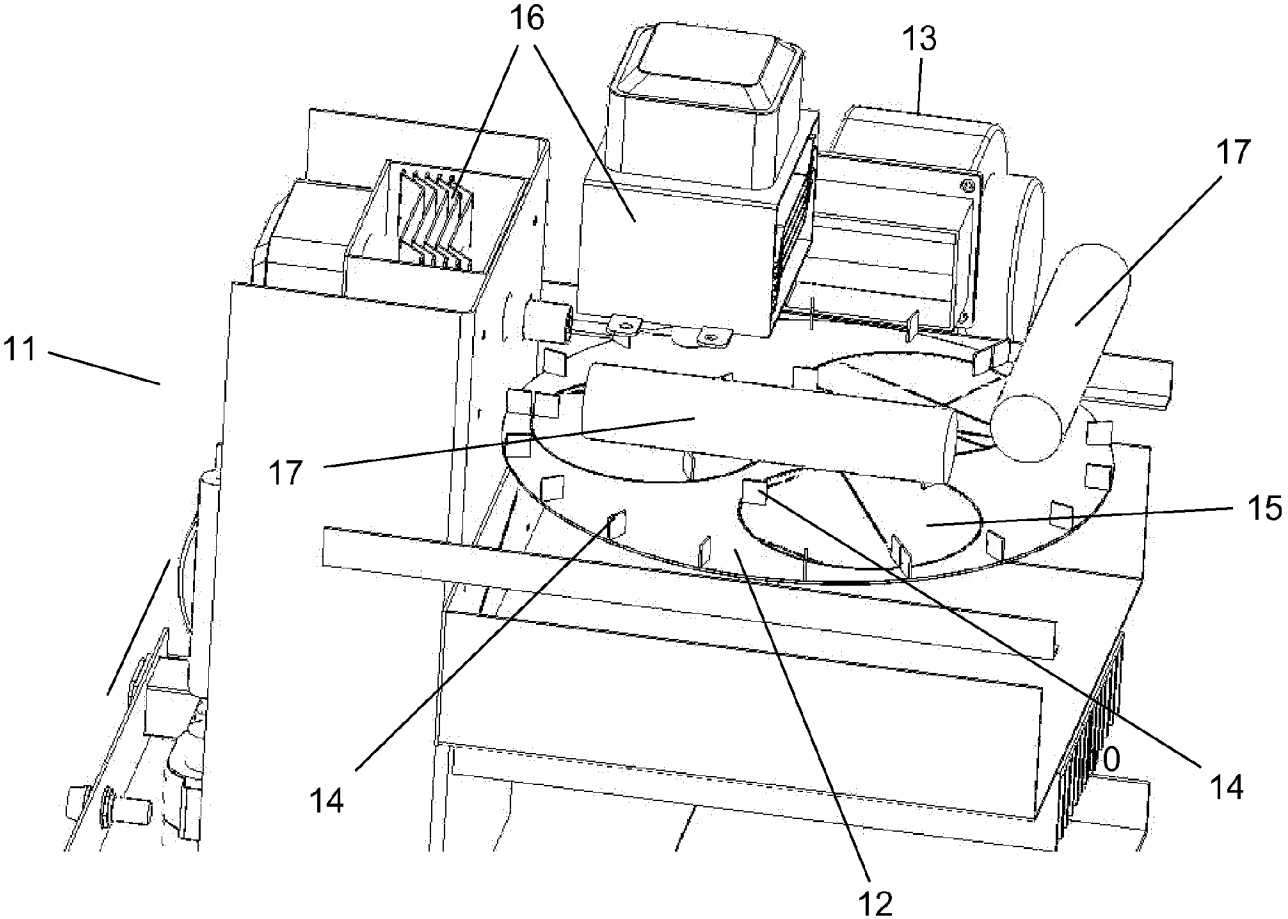
FIG. 1 is a drawing that shows perspective view of the interior parts of the drying oven according to the present invention.
Figure 2:
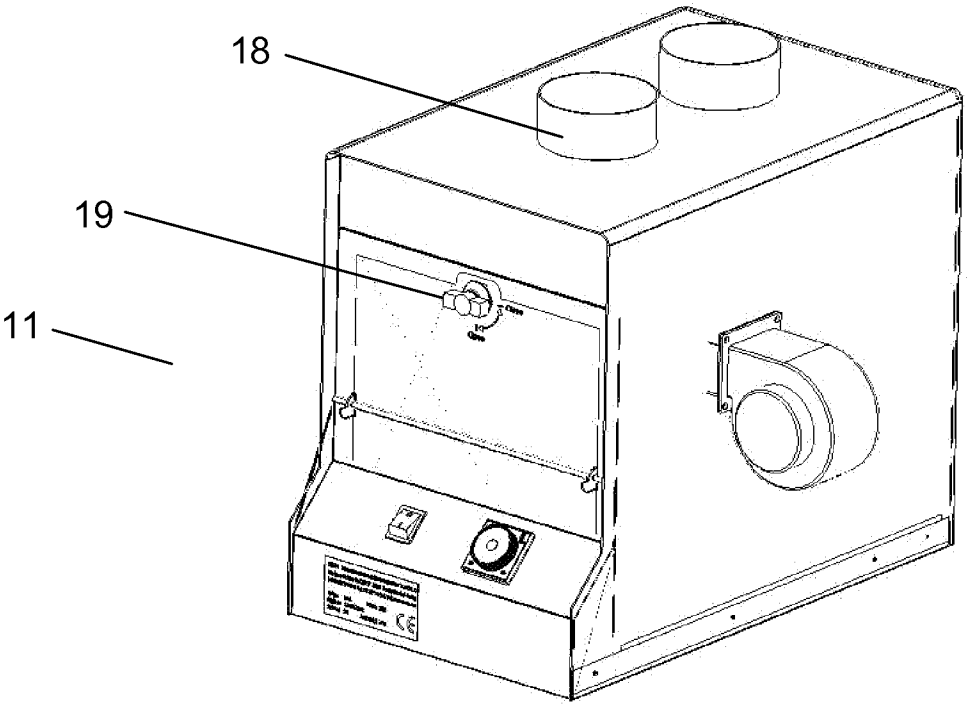
FIG. 2 is a general perspective view of the drying oven according to the present invention.

In view of the drawings having aforementioned brief explanations, the present invention relates to an automatic drying oven (11) where the device, in an embodiment, comprises a bidirectionally rotating low power motor-reducer group driving a holey planetary rotating plate (12), or an arrangement having vanes (14) where said plate (12) can be rotated with the air originating from a fan (13). In accordance with the present improvement, the radiation sources are activated according to the selected program when the sample is put in place (15) and cover is closed as will be explained in the following description.

The plate (12) of the present invention where flow of cooling air may be adjusted by the motor or flap is rotated slowly (e.g. one revolution/min) by said cooling air and drying procedure of the water based paint film having a thickness of a few hundreds of microns is completed within a couple of minutes. According to the present invention, there is a temperature sensor located in the front side where in the case of charcoal like absorbent material having ability of absorbing microwaves, and which particularly absorbs the excess/non-absorbed microwave energy due to excessive heating; this is detected by said sensor whereby the system is shut down for temperatures above 60 degree Celsius. The reservoir absorbing the excess energy is controlled by a thermostat in the case where preventing the excessive heating of the reservoir material and deactivating the microwave generator are important safety measures.

In the drying oven (11) of the present invention, there exist drying means, more specifically heater/dryer/microwave sources having powers of about 800 Watts. Said radiation sources (16, 17) can well be placed in different alignments, however each of them can be consisting of a conventional resistance heater, blowing heater and/or cooler, and ultraviolet, infrared and microwave radiation sources in horizontal and vertical or intermediate angles. In the configuration of FIG. 1, the reference number 16 represents the magnetrons and reference number 17 represents the IR, UV lamps. According to the invention, combinations of UV, IR or conventional methods of heating by blowing as in the hair drying apparatus are within the capacity of the present invention. Filters are provided right in front of the radiation sources (16, 17) so that sample would not undergo a chemical change depending on the type of the procedure. Said filters behave as physical covers that protect the radiation source (16, 17) from exterior effects, and further being used for filtering wavelengths that may lead to a chemical change in the sample where such wavelengths are not desired.

When the dryer radiation sources (16, 17) and rotating plate (12) of the invention are actuated, they operate for a certain period and system is stopped thereafter. Accordingly a time counter starts to count upon the system activation and ensures the system to automatically stop after a certain period. The radiation sources (16, 17) can be placed in various combinations according to the present invention. As consequence, various combinations of radiation sources can be used in different locations.

Although the oven (11) provided by the present invention is designed for purposes of samples that are being applied paint pieces, the oven also provides the potential of implementation in bacteriology, genetics, food and various chemical fields. The lower limit of drying period in the drying oven (11) of the present invention may be in the order of a few seconds. This period may be sufficient for complete drying in the case of paints that forms very thin films having relatively lower water/solvent content.

In the drying oven (11) of the present invention, the radiation sources (16, 17) placed on the plate are located horizontally and vertically with respect to the sample, and are in a non-circular geometry relative to the trajectory of the samples, the trajectory consisting of multiple circular lines in the cabin. Channels suitable for directing radiation may consist of square, rectangle and annular cross sections. The rotation program of the plate moves the samples in a varying manner, and provides effective/optimum drying of the sample by way of exposure in certain intervals and in many times. Also in the gaps of this circular planetary structure the energies such as infrared and ultraviolet can be transmitted to the sample, said sample can be cooled by fans blowing hot/cold air, can be heated and water/solvent thereof can be discharged through a funnel.

In accordance with the present invention, the distance of the dipole of the ultraviolet, infrared, visible ray and microwave radiation sources (16, 17) to the sample is about one fourth of the wavelength. In other words, one fourth of the length of the first wave or primer wave is in a distance approximately equal to the sample distance. Thus, the maximum point of the first amplitude coincides with the sample.

As known in the field, when a wave is forced into a channel narrower than its wavelength its intensity immediately approaches to zero. Following this principle, microwave energy leakage is minimized by narrowing the gaps or imbricating said gaps.

The present oven (11) also comprises a housing (18) in the form of a drawer for putting the samples and a funnel outlet for removing volatile substances depending on the air flow. On the other hand, the present drying oven (11) comprises a programmed controller enabling application of various radiation sources (16, 17) in different periods and repetitions, and carrying out heating, cooling and removal of water/solvent.

The invention claimed is:

1. A drying oven (11) comprising a bidirectionally rotating planetary plate (12) for drying a product sample quickly and automatically within a standard period upon which sample, a paint, chemical substance or food material is applied characterized in that said drying oven (11) comprising a first drying means (16) emitting microwaves, a second drying means (17) emitting ultraviolet or infrared waves wherein said planetary plate accommodating the sample is located at a position one fourth of the wavelength away from said first drying means (16).

2. A drying oven (11) according to claim 1 wherein said oven (11) comprises a further drying means in the form of a resistance heater or a blower.

3. A drying oven (11) according to claim 1 wherein said drying means are configured in horizontal, vertical or intermediate angle arrangement with respect to the sample.

4. A drying oven (11) according to claim 1 wherein the oven (11) is adapted to dry said sample on a holey plate driven by the bidirectionally rotating motor.

5. A drying oven (11) according to claim 1 wherein, the oven (11) further comprises sensors that detect the sample thickness and determine a predetermined processing format when the sample is put in place (15), said sensors enabling subsequent activation of said the radiation sources (16, 17).

6. A drying oven (11) according to claim 1 wherein the oven (11) further comprises a charcoal based material capable of absorbing microwaves for absorbing non-absorbed energy in the cabin of said oven (11).

7. A drying oven (11) according to claim 1 wherein the oven further comprises a reservoir monitored by a thermostat whereby the radiation sources (16, 17) can be deactivated in case the reservoir liquid exceeds a predetermined temperature.

8. A drying oven (11) according to claim 1 wherein the oven comprises filters functioning as physical covers in front of the radiation source (16, 17) protecting said source from exterior effects and filtering wavelengths that may lead to a chemical change in the sample.

9. A drying oven (11) according to claim 1 wherein the radiation sources (16, 17) are placed on or aside of said plate (12), such that said sources (16, 17) are in horizontal, vertical and intermediate angle arrangement with respect to said sample.

10. A drying oven (11) according to claim 1 wherein the oven comprises a programmed controller for application of the various radiation sources (16, 17) in different periods and repetitions on the plate (12) having planetary sample housings capable of rotating bidirectionally in different speeds, and for carrying out heating, cooling, removal of water/solvent.

11. A drying oven (11) according to claim 1 wherein rotation of the planetary plate (12) or plates for the sample (15) is maintained by air circulation provided by the fans (13) and impinging on a flap or flaps.

12. A drying oven (11) according to claim 1 wherein the oven further comprises a housing (18) in the form of a drawer for putting the samples and a funnel outlet for removing volatile substances from the medium.

* * * * *